United States Patent [19]

Amano et al.

[11] Patent Number: 4,568,133

[45] Date of Patent: Feb. 4, 1986

[54] CONNECTOR SOCKET

[75] Inventors: Katsutoshi Amano, Yokohama; Yoshinori Yamane, Machida; Tadayoshi Ezure, Isesaki, all of Japan

[73] Assignees: Sony Corporation, Tokyo; Hosiden Electronics Co., Ltd., Osaka, both of Japan

[21] Appl. No.: 654,276

[22] Filed: Sep. 25, 1984

[30] Foreign Application Priority Data

Oct. 4, 1983 [JP] Japan ..... 58-186576

[51] Int. Cl.[4] ..... H01R 15/10

[52] U.S. Cl. ..... 339/14 R; 339/111; 339/143 R

[58] Field of Search ..... 339/143 R, 143 T, 94 R, 339/94 M, 111, 14 R, 14 P

[56] References Cited

U.S. PATENT DOCUMENTS 2,863,131 12/1958 Carlzen et al. ..... 399/143 T
3,445,805 5/1969 McLoad ..... 339/94 R
3,550,065 12/1970 Phillips ..... 339/143 R
4,453,798 6/1984 Asick et al. ..... 339/143 R
4,457,574 7/1984 Walters ..... 339/143 R

*Primary Examiner*—John McQuade
*Attorney, Agent, or Firm*—Pollock, Vande Sande and Priddy

[57] ABSTRACT

Female contacts are fixedly held in insertion channels formed in a body of a connector socket. A conductive plate is disposed on a front face of the body in contact therewith. In the conductive plate are formed small holes of a diameter slightly greater than that of conductive pins of a plug, in opposing relation to the insertion holes. The conductive plate has an integral grounding terminal. The arrangement is such that, when the plug pins are inserted into the holes of the conductive plate, as the plug pins are being inserted into the female contacts of the socket, any electrostatic charge on the pins is discharged to ground via the conductive plate and grounding terminal rather than being discharged from the pins to the socket contacts.

4 Claims, 6 Drawing Figures

CONNECTOR SOCKET

BACKGROUND OF THE INVENTION

The present invention relates to a connector socket for making electric connection upon insertion of a plug thereinto, and more particularly to a connector socket designed to prevent electric circuits connected thereto from being affected by electric charges stored in the conductor pins of a plug inserted in the connector socket.

It is customary practice to electrically connect a video camera and a video tape recorder to each other by inserting a plug coupled to a cable of the video camera into a connector socket mounted on the video tape recorder. There are instances where the plug connected to the video camera is electrically charged for some reasons. When the plug with its electrically charged conductor pin is connected to the socket of the video tape recorder, the charge is discharged through electric circuits in the video tape recorder to damage or destroy an IC in the video tape recorder.

To protect the circuit in the video tape recorder, the plug and the connector socket have electrically conductive outer shells made of metal, with the conductive pin of the plug being covered with the conductive outer shell, so that when the plug is placed in an electric field, the outer shell is charged, but the conductive pins are prevented from being charged. Any charge induced in the plug outer shell when the plug is inserted into the socket is drained to a grounding circuit in the video tape recorder through the socket outer shell which is in contact with the plug outer shell.

The conductive outer shells of the plug and socket are generally in the form of die castings for the reason that since the outer shells are relatively complex in shape, they could not be manufactured by a less costly process such as pressing. Therefore, the plug and the connector socket with metal outer shells have been expensive.

The plug covered with the metal outer shell can shield the conductive pins from an exterior electric field to prevent the conductive pins from being electrically charged. However, there may be a condition in which a wire connected to the plug cable is subjected to an electric field generated in the video camera and hence is electrically charged. Should this happen, the conductive pins of the plug are electrically charged regardless of the fact that the plug outer shell is made of metal. The charge in the wire will be discharged through the circuit in the video tape recorder when the video camera is connected to the video tape recorder, resulting in the danger of damage to the IC in the video tape recorder.

Therefore, even with the metal outer shell of the plug, it has not been possible to eliminate electric charges generated in the video camera and to prevent the IC in the video tape recorder from being damaged.

SUMMARY OF THE INVENTION

It is a first object of the present invention to provide a connector socket capable of reliably discharging charges induced in the conductive pins of a plug when the plug is connected to the connector socket.

A second object of the present invention is to provide a connector socket which has an outer shell made of a resin material and can be manufactured inexpensively, while having the ability to prevent ICs connected thereto from being damaged due to electric charges.

According to the present invention, a flat disc-shaped conductive plate is disposed on a front surface of a body of a connector socket, the plate having small holes of a diameter slightly greater than that of conductive pins of a plug to be inserted into the connector socket. When the plug is inserted into the connector socket, the conductive pins are brought through the small holes in the conductive plate into contact with female contacts in the connector socket.

If the conductive pins are electrically charged, the charge flows from the conductive pins to the conductive plate as a result of a discharge occurring between the conductive pins and the conductive plate as they approach each other when conductive pins pass through the small holes in the conductive plate. With the conductive plate connected to a grounding circuit in a video tape recorder, for example, the charge can be drained to the grounding circuit. Where a charge is present between a plurality of conductive pins, a discharge takes place between the conductive pins and the conductive plate to permit the charge to be drained from the conductive pins to each other through the conductive plate.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
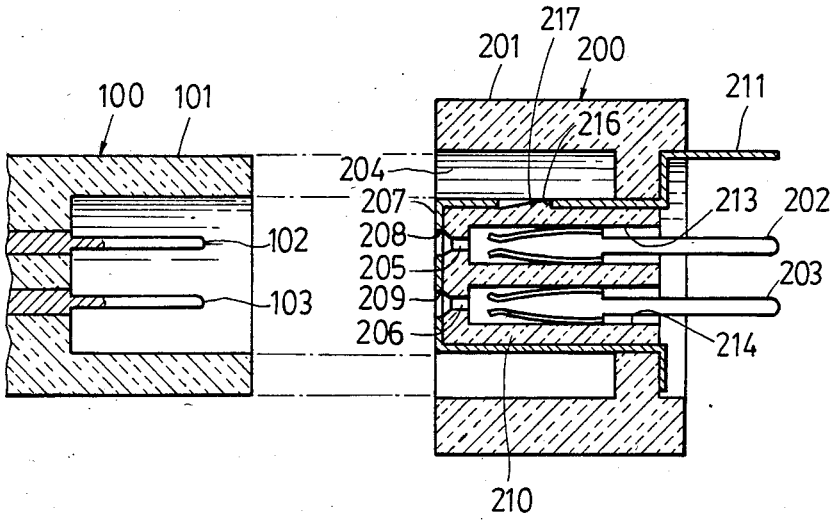
FIG. 1 is a fragmentary cross-sectional view of a connector of the present invention and a plug to be coupled therewith.

As shown in FIG. 1, a connector socket 200 according to an embodiment of the present invention is connected to a plug 100. The plug 100 has a body 101 made entirely of electrically insulative synthetic resin and including a cylindrical front end. The plug 100 has conductive pins 102, 103 disposed in the cylindrical front end and extending parallel to the axis thereof, the conductive pins 102, 103 having rear ends inserted in place in a rear portion of the body 101.

The connector socket 200 is composed of a body 201 and female contacts 202, 203 accommodated in the body 201. The body 201 is made entirely of electrically insulative synthetic resin. The body 201 has an annular recess 204 defined in a front portion thereof and shaped complementarily to the cylindrical front end of the plug 100 so that the cylindrical front end thereof will be snugly fitted into the annular recess 204. The annular recess 204 surrounds a cylindrical stud 210 which accommodates therein the female contacts 202, 203 extending parallel to the axis thereof. In the illustrated embodiment, the body 201 has contact housing channels 213, 214 defined therein and extending from a rear end thereof toward a front end of the cylindrical stud 210, the female contacts 202, 203 being disposed in the contact housing channels 213, 214, respectively. The female contacts 202, 203 have front contact portions which are shaped as forks, but may be of other shapes. Pin insertion holes 205, 206 are defined in the cylindrical stud 210 of the body 201 and extend from tip ends of the female contacts 202, 203 toward the front end of the cylindrical stud 210 in communication with the contact housing channels 213, 214, respectively. The conductive pins 102, 103 of the plug 100 can be brought into electric contact with the female contacts 202, 203, respectively, by inserting the conductive pins 102, 103 through the corresponding pin insertion holes 205, 206 into the connector socket 200. The female contacts 202, 203 have rear ends projecting rearward from the rear end of the body 201 and serving as terminals.

According to the present invention, a flat disc-shaped electrically conductive plate 207 is mounted on the front end surface of the cylindrical stud 210 in which the pin insertion holes 205, 206 are defined. The conductive plate 207 has small holes 208, 209 having a diameter slightly greater than that of the conductive pins 102, 103. The small holes 208, 209 have central axes aligned with the central axes of the pin insertion holes 205, 206 defined in the cylindrical stud 210. Therefore, the conductive pins 102, 103 are kept in contact with the female contacts 202, 203, respectively, through the small holes 208, 209. The conductive plate 207 is held against the front end face of the cylindrical stud 210 and is surrounded by the annular recess 204, the conductive plate 207 being of the same size as the front end face of the cylindrical stud.

Figure 2:
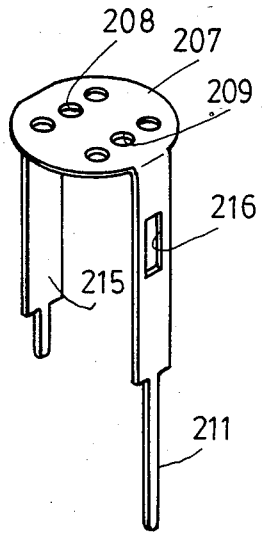
FIG. 2 is a perspective view of a conductive plate.

The disc-shaped conductive plate 207 has an elongated strip-shaped terminal 211 formed integrally therewith and bent perpendicularly thereto to extend rearward beyond the rear end of the socket body 201 as shown in FIGS. 1 and 2. The terminal 211 can be connected, as desired, to a grounding circuit in an apparatus such as a video tape recorder on which the connector socket 200 is mounted. An attachment leg 215 is also integrally formed with the conductive plate 207 in diametrically opposite relation to the terminal 211. The terminal 211 and the attachment leg 215 project from the rear end of the body 201. The conductive plate 207 is attached securely to the body 201 by bending the projecting ends of the terminal 211 and the attachment leg 215 away from each other. The bent end of the terminal 211 is further bent rearward at a right angle to the rear end of the body 201. In order to allow the cylindrical front end of the plug 100 to be inserted smoothly into the annular recess 204, the cylindrical stud 210 of the body 201 has on its peripheral surface longitudinal shallow grooves positioned in radially confronting relation to the terminal 211 and the attachment leg 215, the said terminal and leg being fitted respectively into the longitudinally shallow grooves. The terminal 211 has a central rectangular hole 216 defined therein and is locked in place by a locking finger 217 which extends outwardly of stud 210 into the hole 216.

Figure 3:
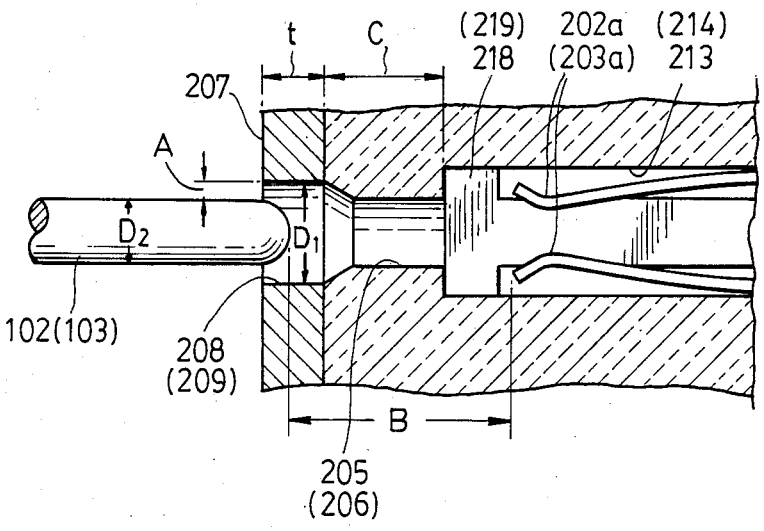
FIG. 3 is an enlarged fragmentary cross-sectional view of a portion of FIG. 1.

When the tips of the conductive pins 102, 103 are positioned in the small holes 208, 209, respectively, in the conductive plate 207, as shown in FIG. 3, the peripheral surface of the conductive pins 102, 103 is spaced a distance A from the conductive plate 207, and the tips of the conductive pins 102, 103 are spaced a distance B from the female contacts 202, 203, the distance A being smaller than the distance B.

The female contacts 202, 203 are forcibly inserted into the contact housing channels 213, 214, respectively, from the rear end of the body 201. The female contacts 202, 203 have contact portions **202*a*, 203*a* and integral positioning members 218, 219 positioned forward of the contact portions 202*a*, 203*a*. The positioning members 218, 219 are held in contact with front end faces of the contact housing channels 213, 214 for thereby positioning the contact portions 202*a*, 203*a* in the longitudinal direction of the contact housing channels 213, 214**.

Typical dimensions of some parts are as follows: The conductive plate 207 has a thickness t of 0.3 mm, the small holes 208, 209 have an inside diameter $D_1$ of 1.5 mm, the conductive pins 102, 103 have an outside diameter $D_2$ of 0.6 mm, and the distance C between the interface of the body 201 and the conductive plate 207 and the front end of the contact housing holes 202, 203 is 0.5 mm.

The connector socket thus constructed will operate as follows: When the tip ends of the conductive pins 102, 103 pass through the small holes 208, 209, if there is an electric charge induced between the conductive pins 102, 103 the charge is discharged through the air gaps A between the conductive plate 207 and the pins 102, 103 since the distance A is small. After the discharge has been completed, the conductive pins 102, 103 are brought into contact with the female contacts 202, 203. Therefore, an IC in a circuit connected to the female contacts 202, 203 is prevented from being damaged by any electric charge between the conductive pins 102, 103.

When the tip ends of the conductive pins 102, 103 pass through the small holes 208, 209 while there is an electric charge induced between one of the conductive pins 102, 103 and ground, if the terminal 211 of the conductive plate 207 is connected to a grounding circuit in the apparatus on which the connector socket is mounted, the charge on the conductive pin 102 or 103 is discharged through the conductive plate 207 and the terminal 211 to the grounding circuit.

When the connector socket 200 is subjected directly to an electric field, since the flat disc-shaped conductive plate 207 is disposed on the front surface of the body 201 and connected to the grounding circuit, the conductive plate 207 serves to shield the female contacts 202, 203 from the electric field to prevent the female contacts 202, 203 from being charged.

With the arrangement of the present invention, in the event that the conductive pins 102, 103 are electrically charged, the charge can be discharged through the conductive plate 207 before the conductive pins 102, 103 come into contact with the female contacts 202, 203. Therefore, it is not necessary to shield the conductive pins 102, 103 and the female contacts 202, 203 by respective metal outer shells, and the bodies 101, 201 of the plug 100 and the connector socket 200 may be formed of a resin material and can be constructed inexpensively.

The connector socket 200 is inexpensive to manufacture and hence highly advantageous in practical use since adverse electrostatic effects can be completely eliminated simply by adding one conductive plate 207 of a simple configuration to the socket.

While in the above embodiment only two conductive pins are shown, it can readily be understood that the present invention is not limited to any particular number of conductive pins which can be provided. In the above embodiment, the plug 100 has a cylindrical portion and the connector socket 200 has an annular recess 204 receptive of the cylindrical portion of the plug 100. It can also be understood that the present invention is not limited in any way to a connector having that particular arrangement. The present invention can be applied to a connector of any type in which a circuit can be connected and disconnected by connecting conductive pins (male contacts) to and disconnecting the conductive pins from female contacts.

Figure 4:
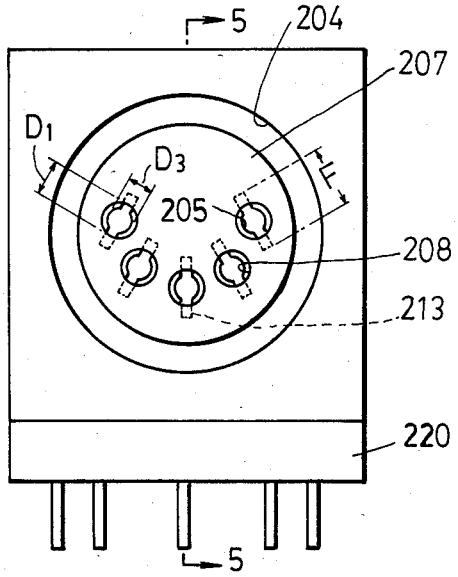
FIG. 4 is a front elevational view of a connector socket according to another embodiment of the invention.
Figure 5:
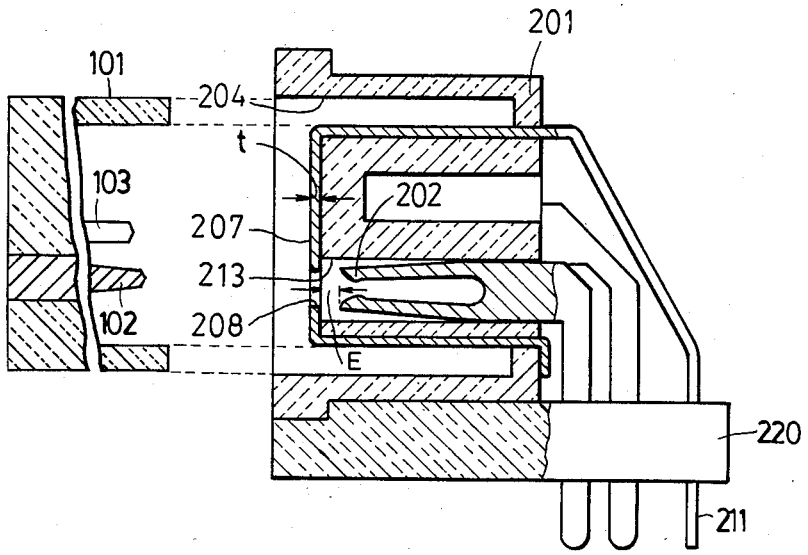
FIG. 5 is a cross-sectional view taken along line 5—5 of FIG. 4.

As illustrated in FIGS. 4 and 5, the present invention is applicable to a connector socket having female contacts 202 each including a terminal bent in a direction normal to the direction in which conductive pins are inserted and removed. A flat disc-shaped conductive plate 207 has a terminal 211 formed integrally therewith, and extending rearwardly of the plate in the same direction in which the terminals of the female contacts 202 extend. The terminal portions of the female contacts 202 and the conductive plate 207 are fixedly held by a base plate 220 that is formed of an insulating material and engaged with a bottom side of the socket body 201. Typically, the tips of the female contacts 202 are spaced from the conductive plate 207 by a distance E of 1 mm, the small holes 208 in the plate have a diameter $D_1$ of2 mm, pin insertion holes 205 have a diameter $D_3$ of 1.3 mm and a length F of 2.9 mm, and conductive pins 102, 103 have an outside diameter $D_2$ of 1 mm.

Figure 6:
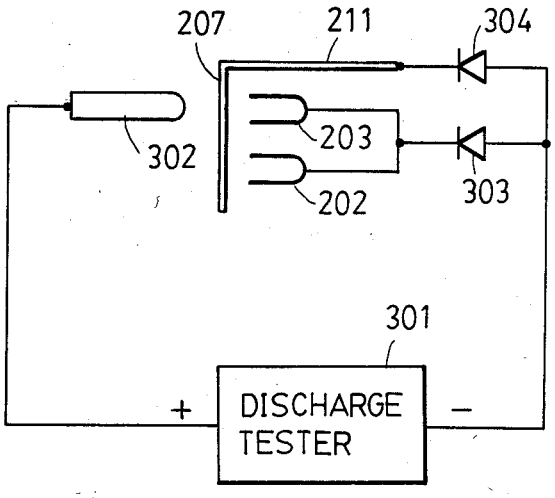
FIG. 6 is a circuit diagram of a test circuit for the connector socket of the invention.

The following test was conducted on the connector sockets of the foregoing embodiments. As shown in FIG. 6, a DC voltage was generated by a discharge testing machine 301 (manufactured by Sanki Denshi Kogyo K.K. under the name "STATIC ELECTRICITY TESTER, MODEL SET 30-A"). The positive terminal of the discharge testing machine 301 was connected to a test probe 302, the negative terminal to cathodes of diodes 303, 304, with the anode of the diode 303 connected to the contacts 202, 203, and the anode of the diode 304 connected to the terminal 211 of the conductive plate 207. When the test probe 302 approached the small holes 208, 209, a discharge condition was visually confirmed and it was also checked that whether a discharge was produced on the contacts 202, 203 or the conductive plate 207 by ascertaining if the diodes 303, 304 were destroyed. The test was carried out ten times for each of the voltages 5 KV, 10 KV, 15 KV, 18 KV, 20 KV, 22 KV, and 25 KV. The same test was conducted on three types of conventional connector sockets having tubular metal covers mounted on socket bodies. Some of the conventional connector sockets allowed a discharge to be produced between the test probe 302 and the contacts. The connector sockets of the two embodiments of the invention produced no discharge between the test probe 302 and the contacts, but allowed a discharge between the test probe 302 and the conductive plates 207.

When the conductive pins charged in the test were inserted into the connector socket, a discharge occurred between the pins and the conductive plate 207 before the pins contacted the contacts 202, 203, and it was confirmed that no charge flowed to the contacts 202, 203.

Although certain preferred embodiments have been shown and described, it should be understood that many changes and modifications may be made therein without departing from the scope of the appended claims.

What is claimed is:

1. A connector socket for electric connection with a plug upon insertion of the plug into the connector socket, comprising:

(a) a body fabricated of an insulative material, the front surface of said body defining an annular recess for receiving a cylindrical portion of the plug, said body including a cylindrical stud which is surrounded by said annular recess, said cylindrical stud having a plurality of contact housing channels defined therein, and said stud also defining pin insertion holes which extend to a front surface of said stud in communication with said contact housing channels;

(b) a plurality of contacts disposed in said contact housing channels, respectively, for electric connection to conductive pins of the plug upon insertion of the conductive pins through said pin insertion holes; and (c) a flat, disc-shaped conductive plate whose shape and size is substantially the same as that of said front surface of said stud, said plate being mounted on said front surface of said stud and having small holes therein in confronting relation to said pin insertion holes, respectively, each of the holes in said disc-shaped conductive plate having a diameter slightly larger than that of the conductive pins of the plug, said conductive plate being integral with an elongated grounding terminal which extends from a marginal edge portion of said plate rearwardly of said plate at substantially right angles to the plane of said plate, said elongated grounding terminal being disposed within and extending along an elongated groove that is defined in the cylindrical surface of said stud whereby said rearwardly extending grounding terminal does not impede insertion of the cylindrical portion of the plug into said annular recess of said socket, the arrangement being such that when the tips of the conductive pins of the plug are positioned in said pin insertion holes, the distance between the conductive pins and the edges of the said small holes in said disc-shaped plate is less than the distance between the conductive pins and said contacts, whereby any electrostatic charge on the conductive pins of the plug is discharged via said plate and grounding terminal to ground rather than being discharged to said contacts of said socket.

2. A connector socket according to claim 1 wherein said contact are connected to terminals, said grounding terminal and said contact terminals projecting in spaced generally parallel relation to one another from one side of said body in directions transverse to the axis of said cylindrical stud.

3. The connector socket of claim 1 wherein said elongated grounding terminal has an aperture therein, said stud including a projection which extends into said aperture for locking said grounding terminal into place in said elongated groove.

4. The connector socket of claim 1 wherein said flat disch-shaped conductive plate has an elongated attachment leg for attaching said plate to said stud, said attachment leg being integral with said plate and extending rearwardly of said plate from a further marginal edge portion of said plate, said attachment leg being disposed within and extending along a further elongated groove that is defined in the cylindrical surface of said stud in spaced relation to said elongated grounding terminal.

* * * * *